US005367960A

United States Patent [19]

Schleicher

[11] Patent Number: 5,367,960

[45] Date of Patent: Nov. 29, 1994

[54] FOUR-WAY SHEET METAL PALLET

[75] Inventor: Hermann Schleicher, Rathsberg, Germany

[73] Assignees: Sigrid Schleicher; Bernd Schleicher; Stefan Schleicher; Gudrun Schleicher, Spardorf, Germany

[21] Appl. No.: 146,760

[22] Filed: Nov. 2, 1993

[30] Foreign Application Priority Data

Nov. 2, 1992 [EP] European Pat. Off. ..... 92118731.6

[51] Int. Cl.[5] ..... B65D 19/00

[52] U.S. Cl. ..... 108/51.1; 108/56.1

[58] Field of Search ..... 108/51.1, 56.1, 56.3

[56] References Cited

U.S. PATENT DOCUMENTS

| | | | |
|---|---|---|---|
| 2,306,752 | 12/1942 | Riemenschneider . | |
| 2,692,107 | 10/1954 | De Ridder et al. | 108/51.1 |
| 3,616,766 | 11/1971 | Weiss | 108/51.1 |
| 4,112,854 | 9/1978 | Pitchford | 108/51.1 X |
| 4,145,976 | 3/1979 | Svirklys | 108/56.1 |
| 4,485,744 | 12/1984 | Umemura et al. | 108/51.1 |
| 4,714,026 | 12/1987 | Yamaguchi et al. | 108/51.1 |
| 5,211,117 | 5/1993 | Beamer | 108/51.1 |

FOREIGN PATENT DOCUMENTS

| | | | |
|---|---|---|---|
| 0015576 | 9/1980 | European Pat. Off. . | |
| 4114888 | 1/1993 | Germany | 108/51.1 |

OTHER PUBLICATIONS

Önorm A 5300, *Vierweg-Flachpalette aus Hols,* Österreichisches Normungsinstitut (Austrian Standards Institute), Vienna, Austria, pp. 1–7, 1 Jan. 1981.

*Primary Examiner*—Jose V. Chen

*Attorney, Agent, or Firm*—Kenyon & Kenyon

[57] ABSTRACT

A four-way sheet metal pallet is disclosed. The pallet consists of rails of undulated cross-section which form at their outer edges closed conical hollow bodies, and of rail-supporting hollow bodies having recesses into which the rails can be fitted in form-locked and centering manner.

12 Claims, 4 Drawing Sheets

FOUR-WAY SHEET METAL PALLET

BACKGROUND OF THE INVENTION

The pallet has gained wide acceptance for the transportation and storage of goods, due in large measure to the European standardization of the four-way flat pallet. Its advantages lie in its suitability for use as a replacement pallet and customary means of conveyance, as well as its underlying structural simplicity.

Pallets made of wood have the disadvantage that upon use in operations in which they are exposed to a high degree of moisture, for instance in breweries, they have only a very short life and must in some cases be replaced after having been used only twice. Pallets of sheet metal have therefore been produced. Aside from the fact that they do not comply with European standards, such pallets have the disadvantage that their strength is insufficient to withstand rough operations or excessive weight. This is true, for instance, of the pallets described in European Patent 0015576 and in U.S. Pat. No. 2,306,752. The pallet produced in accordance with European patent 0015576 consists of sheet metal which has been bent in the manner of undulations. It is produced from only one sheet metal blank, the ends of which are bent off to form box-like hollow bodies. The hollow bodies thus also form the side walls of the pallet. Such pallets on the one hand do not comply with the standards set forth by the EEC and on the other hand they do not meet the strength requirements necessary for certain uses unless the thickness of the sheet metal of which they are constructed is increased to the point that they weigh too much.

In addition, there has been proposed a sheet metal pallet which consists of undulated metal strips of the same wave cross-section in connection with which the outer terminal regions of the side walls are bent to form triangular hollow sections and are firmly connected at their ends to the side walls. These pallets meet the strength requirements but they have the disadvantage that a large number of welded connections are required, which in its turn greatly impairs the corrosion protection of the galvanized sheet metal which is customarily used. There remains a need for a pallet that is constructed of sheet metal that is not excessively heavy, is sufficiently strong, and that meets European specifications.

SUMMARY OF THE INVENTION

This invention meets this need by providing a sheet metal pallet which is manufactured in compliance with the standards for four-way flat pallets and in which the number of connections for the individual pallet parts is reduced or their area is reduced whereby the areas of attack for corrosion are greatly reduced. In addition to this, the inventive design reduces the labor required for the manufacture of the pallet even as the strength of the pallet is increased without an increase in weight as compared with the previous designs.

As in the case of the previously mentioned pallet, the sheet metal pallet of the invention is made of undulated rails and supporting hollow bodies of the same cross-section. In contrast to other pallets, the outer edges of the rails of this pallet are developed as closed and firmly connected hollow bodies of conical (i.e., generally triangular) cross-section, and the approximately block-shaped supporting hollow bodies have recesses at two upper opposite edges of the side walls and, at a right angle thereto, on two lower opposite edges of their side walls, which recesses correspond to the cross-section of the rails so that the latter can be fitted into the supporting hollow bodies in form-locked self-centering manner.

The particular advantage of the invention is based on the fact that the form-locked and centering development of the rails with conical hollow bodies and matching recesses in the practically block-shaped supporting hollow bodies increases the strength. The bending stress associated with this design is also greatly reduced.

In addition to this, pressure joints can be provided as connections for the new pallet which reduces the regions of increased risk of corrosion practically to a minimum. The use of pressure joints to form a connection in the case of the new pallet is particularly advantageous when the supporting bodies consist of several parts in which specially bent undulated metal strips can be used for this purpose.

BRIEF DESCRIPTION OF THE DRAWINGS

For a more detailed explanation, reference is had to the drawings, in which.

Figure 3:
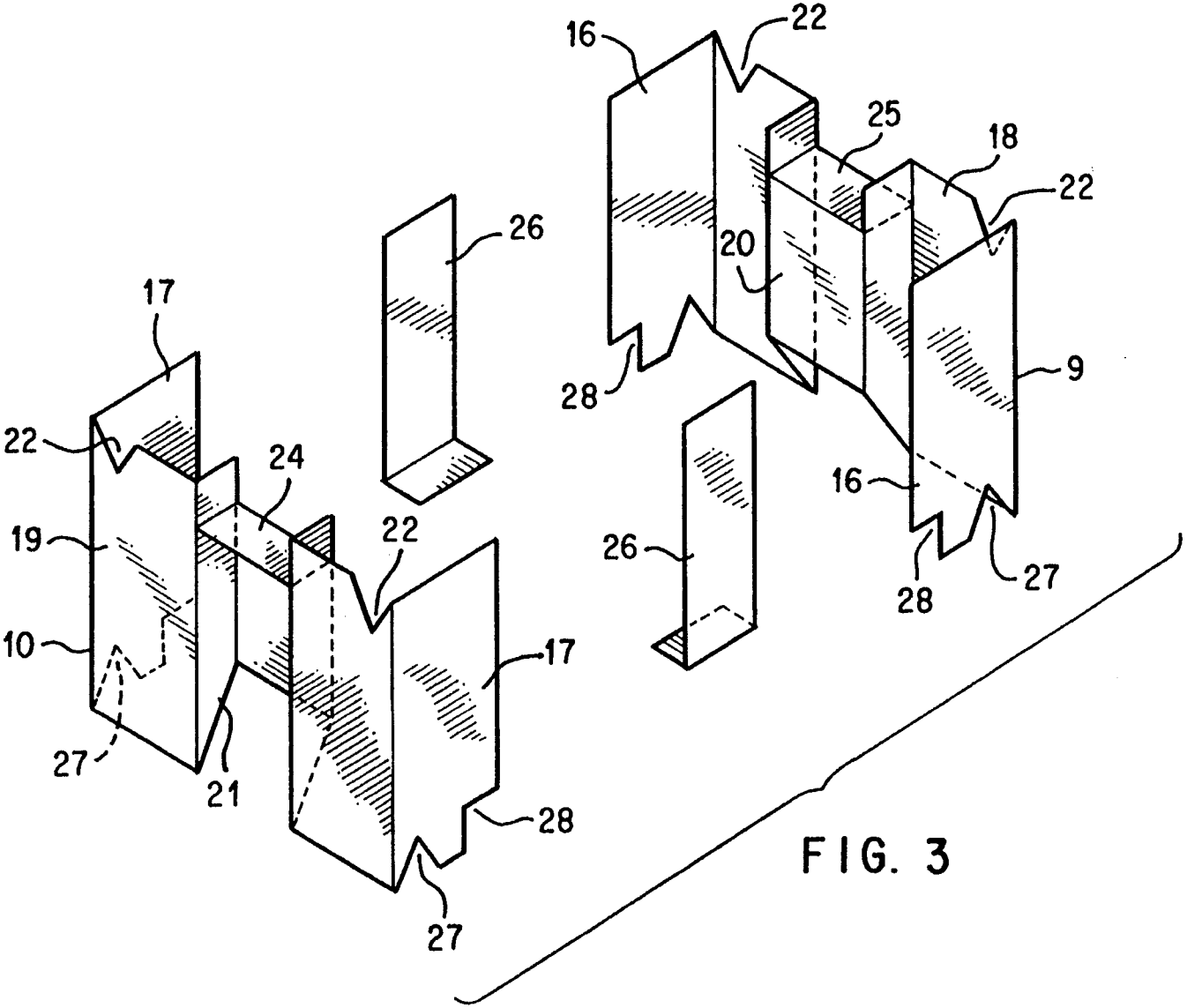
Figure 4:
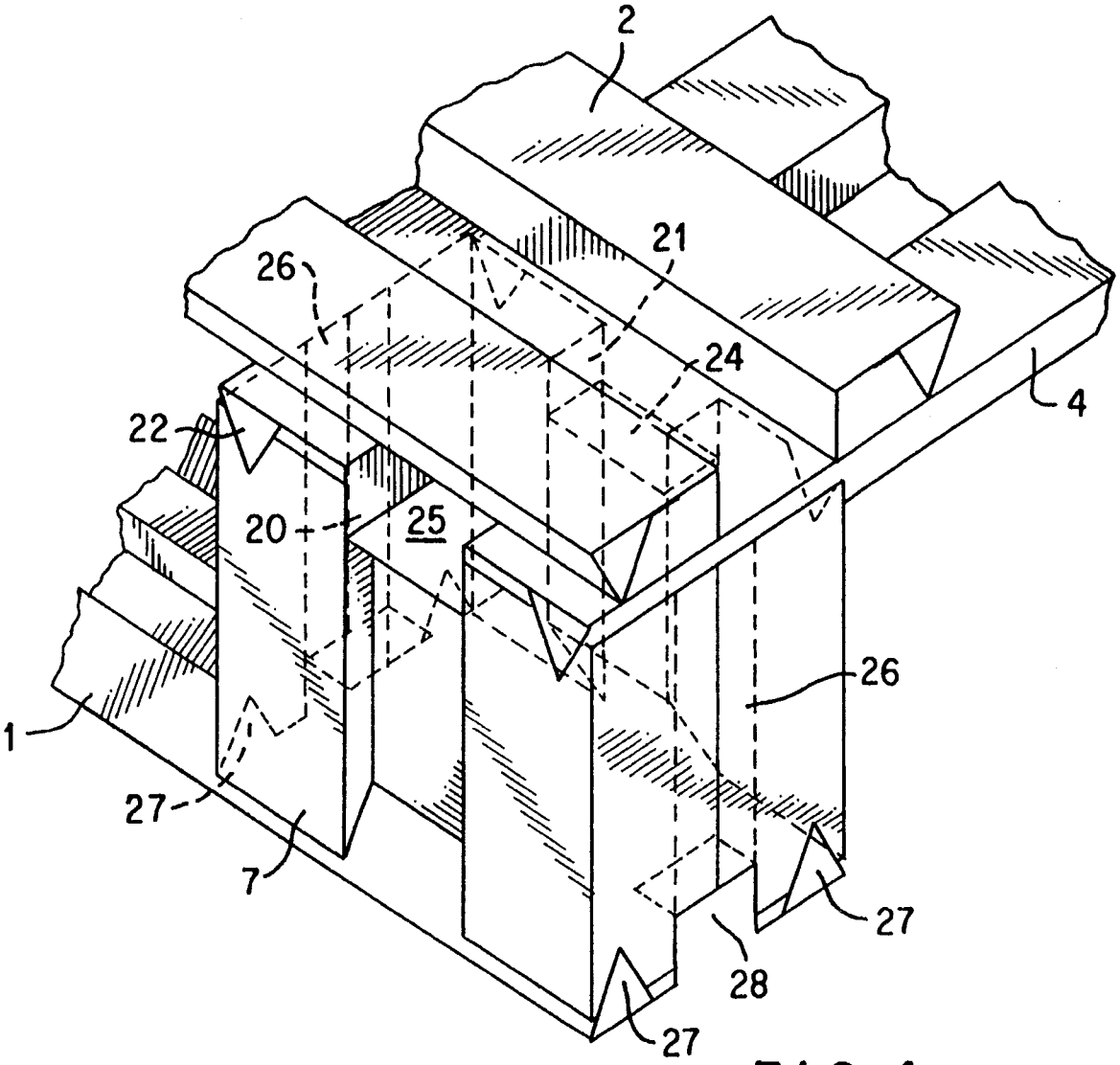

FIGS. *2a* and *2b* illustrate a rail in cross-section;

FIG. 3 illustrates a two-part supporting hollow body in an exploded view;

FIG. 4 illustrates a corner connection of the sheet metal pallet.

DETAILED DESCRIPTION

Figure 1:
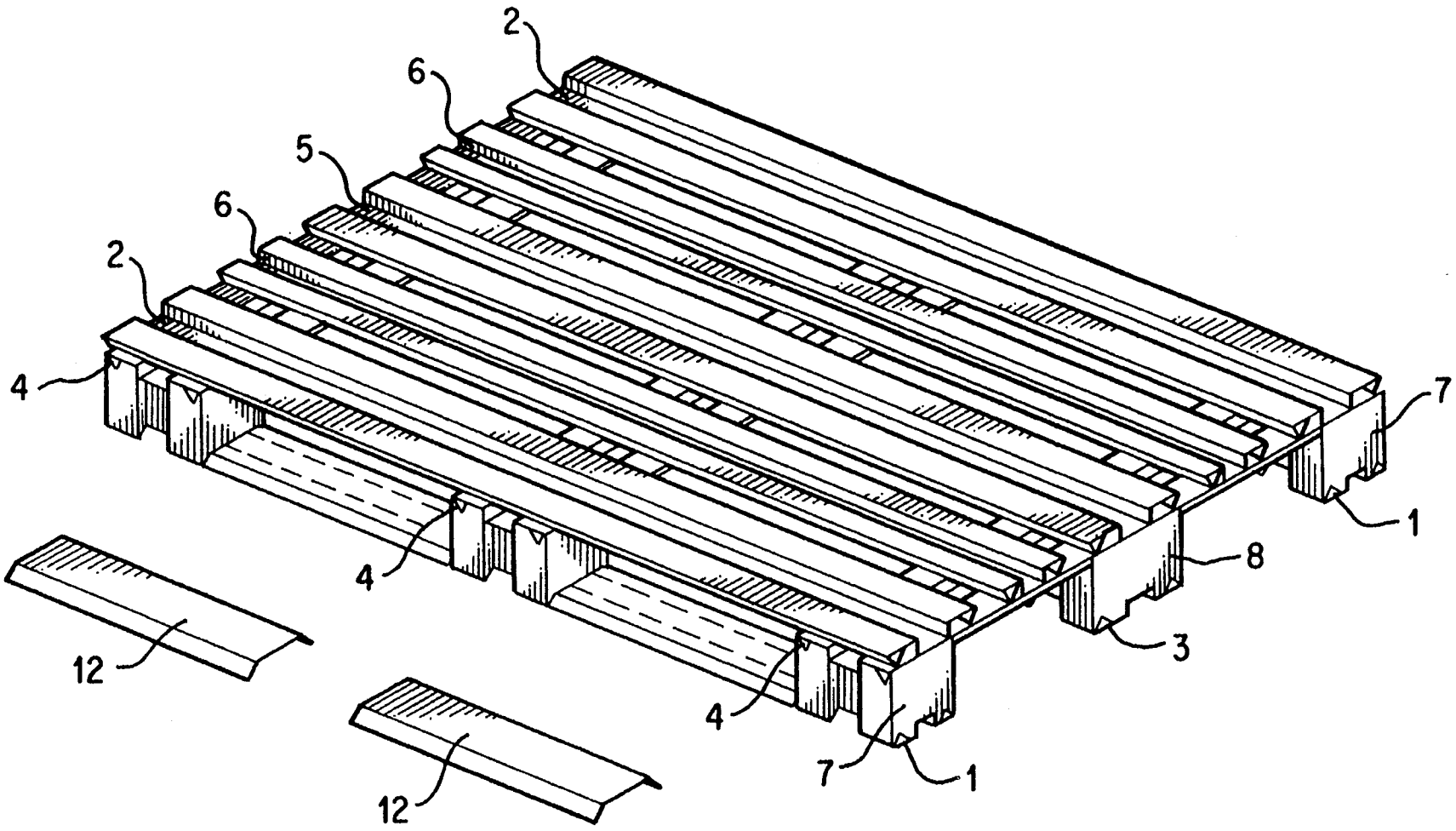
FIG. 1 is an overall perspective view of the sheet metal pallet.

FIG. 1 is a perspective view of a sheet metal pallet constructed according to the principles of the invention. Supporting hollow bodies 7, 8 are placed on two bottom edge rails 1 and the bottom center rail 3. Three transverse rails 4 are inserted, at a right angle to the bottom edge rails 1 and the bottom center rail 3, from the top into the recesses of the supporting hollow bodies 7, 8. Two cover edge rails 2, two cover inner rails 6 and one cover center rail 5 are arranged on the transverse rails 4 parallel to the bottom edge and bottom central rails 1 and 3 respectively. The firm connection between the rails 1–6 and the supporting hollow bodies 7, 8 is preferably established by pressure joints, although other known means of joining, such as welding or riveting, can be used to join the various parts of the pallet.

In order to protect the rails 1–6 against damage by means of conveyance, said rails can be covered by protective metal sheets 12 in each case between two supporting hollow bodies. The sheet metal pallet shown corresponds in its dimensions to the standards for the European replacement pallet (see Austrian standard A 5300, which is herein incorporated by reference).

Figure 2A:
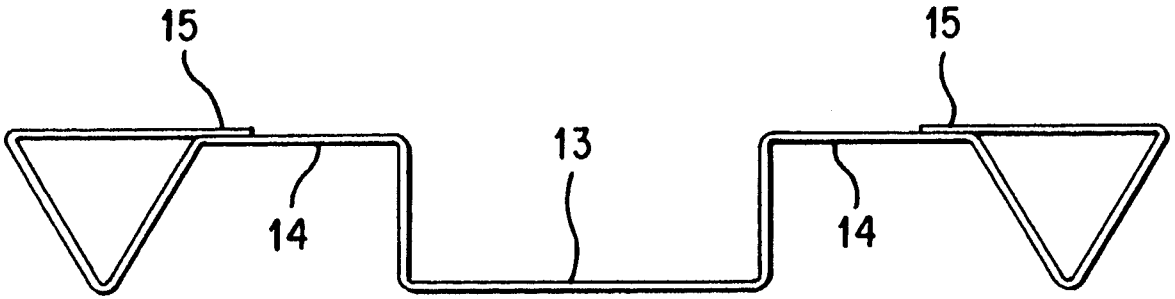
Figure 2B:
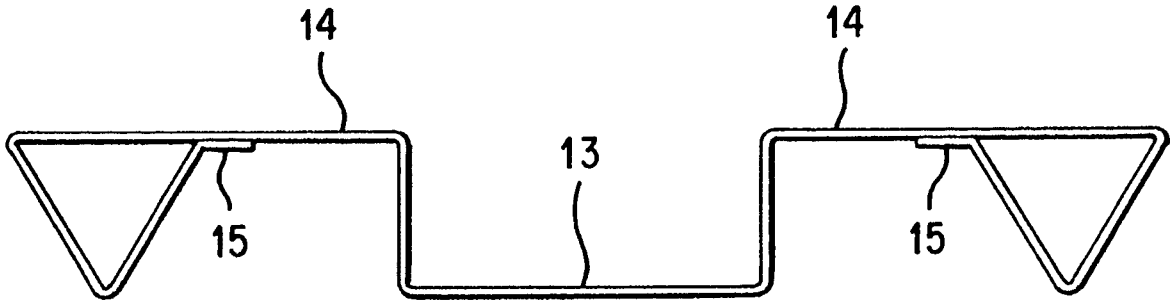

FIG. 2 shows one of the possible cross-sectional shapes of the rails 1–6. A U-shaped rail part 13 is adjoined to the right and to the left by in each case one horizontal rail part 14. The end region of the horizontal rail part 14 is in each case bent downward to form a triangle with an attachment tab 15. The attachment tab 15 can in this case be arranged as desired above (FIG. *2a*) or below (FIG. *2b*) the horizontal rail part 14. The attachment tabs 15 are firmly connected to the horizontal rail part 14 by pressure joints. There is thus produced at the outer edges of the rails 1–6 a closed hollow body of conical cross-section. Instead of a triangular cross-section there can also be provided any other conical, for instance trapezoidal cross-section.

The supporting hollow body 7 shown in an exploded view in FIG. 3 comprises partial hollow bodies 9 and 10. The latter consist of bent U-shaped metal sheets having two arms 16, 17. In the central region, the side walls 18, 19 are bent inward in U-shape. The width of the U-shaped bend 20, 21 corresponds to the width of the U-shaped rail part 13. At the upper edge of the side walls 18, 19 triangular recesses 22 have been cut out corresponding to the cross-section of the transverse rails 4. In the U-shaped region of the side walls, 19, 20, attachment tabs 24, 25 are bent outward at a right angle on top so that the transverse rail 4 can be fitted into the side walls 18, 19 of the supporting hollow body 7. The attachment tabs 24 can be developed also as individual angle sheets. The arms 16, 17 of the partial hollow bodies 9, 10 are connected by means of the angle sheets 26. In this way there are produced two additional side walls 16, 17, 26 which have recesses 27, 28 at their bottom edge which correspond to the cross-section of the bottom edge rail 1 and the bottom center rail 3.

For a better understanding of the structural assembly of the sheet metal pallet of the invention, a corner connection of the sheet metal pallet has been shown in FIG. 4.

The bottom edge rail 1 is arranged on the bottom, the supporting hollow body 7 being placed on the end of the bottom edge rail 1 corresponding to its recesses 27, 28. By means of the angle sheets 26, the bottom edge rail 1 is connected by pressure joints to the supporting hollow body 7.

The transverse rail 4 is fitted into the upper recesses 22 and the U-shaped bend 20, 21, the transverse rail 4 being in its turn connected to the bent off attachment tabs 24, 25. The cover edge rail 2 is attached at a right angle to the transverse rail 4.

Due to the development of the outer edges of the rails 1–6 as closed hollow bodies, the strength of the rails is considerably increased.

The conical development—triangular in the drawing—has a centering effect due to its form-locked arrangement in the supporting hollow bodies 7, 8 and thus increases the stability of the sheet metal pallet.

The use of the pressure joints throughout increases the corrosion resistance in the case of coated metal sheets and reduces the expense for labor.

One particular advantage of the supporting hollow bodies 7, 8 described consists in the fact that electronic automation means such as sensors and transmitters can be arranged in the bends 20, 21. In this case, the supporting hollow bodies 7, 8 may have to be made of non-magnetic material, for instance aluminum.

What is claimed is:

1. A four-way sheet metal pallet, comprising:

a plurality of undulated rails, said rails having a cross sectional shape whose terminal lateral portions enclose conically shaped regions;

a plurality of supporting hollow bodies for supporting said rails, said hollow bodies comprising oppositely disposed side walls having upper and lower edges each of said hollow bodies being of equal cross-sectional shape and providing generally block-shaped supports for the rails, wherein the hollow bodies have recesses on two upper opposite edges of the side walls and at a right angle thereto on two lower opposite edges of the side walls, wherein the recesses correspond in shape to the cross-sections of the rails so that the rails can be fitted into the supporting hollow bodies in a form-locked and centering manner.

2. A four-way sheet metal pallet according to claim 1, wherein the conical hollow bodies of the rails are triangular in cross-section.

3. A four-way sheet metal pallet according to claim 1, wherein the supporting hollow bodies are constructed of a plurality of elements.

4. A four-way sheet metal pallet according to claim 1, wherein the supporting hollow bodies have formed thereon tabs or similarly angled portions of sheet metal that are at least partially orthogonal to the side walls for connection to the rails.

5. A four-way sheet metal pallet according to claim 1, wherein pressure joints are provided for the connections within the rails and within the supporting hollow bodies and for the connections between rails to the supporting hollow bodies.

6. A four-way sheet metal pallet according to claim 1 further comprising protective sheets that are configured to overlie the rails in between the bottom bodies which support the rails.

7. A pallet, comprising:

a plurality of rails having a cross sectional shape that is open at its center and closed at its lateral portions, wherein the closed lateral portions have the shape of a polygon in cross section;

a plurality of supporting hollow bodies for supporting said rails, said hollow bodies being formed of a series of identical sections having side walls, that have upper and lower edges recesses located along said upper and lower edges of orthogonally disposed portions of the hollow bodies, and tab portions, that are at least partially orthogonal to the side walls wherein the recesses of the hollow bodies are configured to interlock with the lateral portions of the rails and the tabs define recesses along which the open portions of the rails interlock.

8. A four-way sheet metal pallet according to claim 7, wherein the closed lateral portions of the rails are triangular in cross section.

9. A four-way sheet metal pallet according to claim 7, wherein the rails are made of metal.

10. A four-way sheet metal pallet according to claim 7, wherein the hollow bodies are made of metal.

11. A four-way sheet metal pallet according to claim 7, wherein the rails and hollow bodies are dimensioned so that they can be interlocked with one another.

12. A four-way sheet metal pallet according to claim 7, further comprising a plurality of protective sheets that are configured to overlie the rails in between the hollow bodies which support the rails.

* * * * *